US011432384B2

(12) United States Patent
Yu et al.

(10) Patent No.: US 11,432,384 B2
(45) Date of Patent: Aug. 30, 2022

(54) LED CONTROL FOR REVERSABLE POWER CABLE

(71) Applicant: Dell Products L.P., Round Rock, TX (US)

(72) Inventors: Wei-Cheng Yu, New Taipei (TW); Tsung-Cheng Liao, Taoyuan (TW); Chi Che Wu, Taipei (TW); Andrew Thomas Sultenfuss, Leander, TX (US)

(73) Assignee: Dell Products L.P., Round Rock, TX (US)

( * ) Notice: Subject to any disclaimer, the term of this patent is extended or adjusted under 35 U.S.C. 154(b) by 71 days.

(21) Appl. No.: 17/028,324

(22) Filed: Sep. 22, 2020

(65) Prior Publication Data

US 2022/0095429 A1 Mar. 24, 2022

(51) Int. Cl.

| | |
|---|---|
| ***H05B 45/32*** | (2020.01) |
| ***F21V 23/00*** | (2015.01) |
| *F21Y 115/10* | (2016.01) |

(52) U.S. Cl.

CPC ..... *H05B 45/32* (2020.01); *F21V 23/001* (2013.01); *F21Y 2115/10* (2016.08)

(58) Field of Classification Search

CPC ..... H05B 45/32; F21V 23/001; F21Y 2115/10

See application file for complete search history.

(56) References Cited

U.S. PATENT DOCUMENTS

2016/0269807 A1* 9/2016 Cohard ..... H04B 10/502
2016/0308452 A1* 10/2016 Motoki ..... H02M 3/33523

FOREIGN PATENT DOCUMENTS

CN 205488923 U * 8/2016
CN 206259570 U * 6/2017

* cited by examiner

*Primary Examiner* — Henry Luong
(74) *Attorney, Agent, or Firm* — Baker Botts, L.L.P.

(57) ABSTRACT

A disclosed method for LED control for a detachable reversable power cable includes detecting, at a power source, that a first connector at a first end of the power cable is connected to the power source, triggering, at the power source, a first pulse on a first wire of the power cable that turns off a first LED switch coupled to a first LED on the first connector, disabling the first LED, and triggering, at the power source, a second pulse on a second wire of the power cable that drives a second LED on a second connector at a second end of the power cable opposite the first end, the second LED being coupled to a second LED switch that is on. The method further includes, responsive to detecting that the second connector is connected to a power sink, modifying a driver path for the second LED.

20 Claims, 8 Drawing Sheets

LED CONTROL FOR REVERSABLE POWER CABLE

BACKGROUND

Field of the Disclosure

This disclosure relates generally to information handling systems and, more particularly, to LED control for a detachable reversable power cable.

Description of the Related Art

As the value and use of information continues to increase, individuals and businesses seek additional ways to process and store information. One option available to users is information handling systems. An information handling system generally processes, compiles, stores, and communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

Examples of information handling systems include portable devices such as notebook computers, media players, personal data assistants, digital cameras, cellular phones, cordless phones, smart phones, tablet computers, and 2-in-1 tablet-laptop combination computers. A portable device may generally be any device that a user may carry for handheld use and that includes a processor. Typically, portable devices are powered using a rechargeable battery and include a display device. The battery is typically charged using a detachable DC power adapter.

SUMMARY

In one aspect, a disclosed method for light emitting diode (LED) control for a detachable reversable power cable includes detecting, at a power source, that a first connector at a first end of a reversable power cable is connected to the power source, triggering, at the power source, a first pulse on a first wire of the reversable power cable that turns off a first LED switch coupled to a first LED on the first connector at the first end of the reversable power cable, disabling the first LED, and triggering, at the power source, a second pulse on a second wire of the reversable power cable that drives a second LED on a second connector at a second end of the reversable power cable opposite the first end, the second LED being coupled to a second LED switch that is on.

In any of the disclosed embodiments, the method may further include responsive to detecting that the second connector at the second end of the reversable power cable is connected to a power sink, modifying a driver path for the second LED on the second connector.

In any of the disclosed embodiments, the first wire on the reversable power cable may carry a first configuration channel signal, the second wire on the reversable power cable may carry a second configuration channel signal, and modifying the driver path for the second LED on the second connector may include decoupling the driver path for the second LED from the second wire on the reversable power cable and coupling the driver path for the second LED to a third wire on the reversable power cable, the third wire carrying a power bus signal.

In any of the disclosed embodiments, the first wire on the reversable power cable may carry a first configuration channel signal and triggering the first pulse may include initiating, by a power delivery controller at the power source, a pulse on the first configuration channel signal, the first configuration channel signal being coupled to the first LED switch.

In any of the disclosed embodiments, the method may further include, prior to detecting that the first connector at the first end of the reversable power cable is connected to the power source, detecting that the second connector at the second end of the reversable power cable is connected to a power sink.

In any of the disclosed embodiments, the method may further include, subsequent to triggering the second pulse, detecting that the second connector at the second end of the reversable power cable is connected to a power sink.

In any of the disclosed embodiments, the method may further include, responsive to a disconnection of the reversable power cable from the power source, disabling the first LED and the second LED.

In any of the disclosed embodiments, the method may further include, responsive to disconnection of the reversable power cable from the power sink, disabling the first LED and the second LED.

In another aspect, a disclosed system includes a reversable power cable that includes a first connector at a first end of the reversable power cable, a second connector at a second end of the reversable power cable, and a length of cable between the first connector and the second connector. The first connector includes a first light emitting diode (LED), and a first LED switch coupled to the first LED and operable to disable the first LED when the first LED switch is off and to couple the first LED to a driving current source when the first LED switch is on. The second connector includes a second LED, and a second LED switch coupled to the second LED and operable to disable the second LED when the second LED switch is off and to couple the second LED to a driving current source when the second LED switch is on. The cable between the first connector and the second connector includes respective wires carrying a power bus signal, a first configuration channel signal, and a second configuration channel signal. The system also includes an external power source for an information handling system. The external power source includes a port for coupling the external power source to the reversable power cable and a power delivery controller. The power delivery controller includes circuitry operable to detect that the first connector is connected to the external power source, to trigger a first pulse on the first configuration channel signal to turn off the first LED switch, disabling the first LED, and to trigger a second pulse on the second configuration channel signal to provide a drive current to the second LED while the second LED switch is on.

In yet another aspect, a disclosed external power source for an information handling system includes a port for coupling the external power source to the reversable power cable and a power delivery controller. The power delivery controller includes circuitry operable to detect that a first connector at a first end of the reversable power cable is connected to the port on the external power source, to trigger a first pulse on a first wire of the reversable power cable that turns off a first light emitting diode (LED) switch coupled to a first LED on the first connector at the first end of the reversable power cable, disabling the first LED, and to trigger a second pulse on a second wire of the reversable power cable that drives a second LED on a second connector at a second end of the reversable power cable opposite the first end, the second LED being coupled to a second LED switch that is on.

In any of the disclosed embodiments, the power delivery controller may further include circuitry operable to, responsive to detecting that the second connector at the second end of the reversable power cable is connected to a power sink, decouple a driver path for the second LED from the second wire on the reversable power cable and couple the driver path for the second LED to a third wire on the reversable power cable, the third wire carrying a power bus signal.

In any of the disclosed embodiments, the power delivery controller may further include circuitry operable to detect that the second connector at the second end of the reversable power cable is connected to a power sink prior to detecting that the first connector at the first end of the reversable power cable is connected to the power source.

In any of the disclosed embodiments, the power delivery controller may further include circuitry operable to detect, subsequent to triggering the second pulse, that the second connector at the second end of the reversable power cable is connected to a power sink.

In any of the disclosed embodiments, the power delivery controller may further include circuitry operable to disable the first LED and the second LED responsive to a disconnection of the reversable power cable from the power source.

In any of the disclosed embodiments, the power delivery controller may further include circuitry operable to disable the first LED and the second LED responsive to a disconnection of the reversable power cable from the power sink.

In any of the disclosed embodiments, the external power source may include at least one of a battery and an AC-DC converter.

BRIEF DESCRIPTION OF THE DRAWINGS

For a more complete understanding of the present disclosure and its features and advantages, reference is now made to the following description, taken in conjunction with the accompanying drawings, in which.

DESCRIPTION OF PARTICULAR EMBODIMENT(S)

Figure 1:
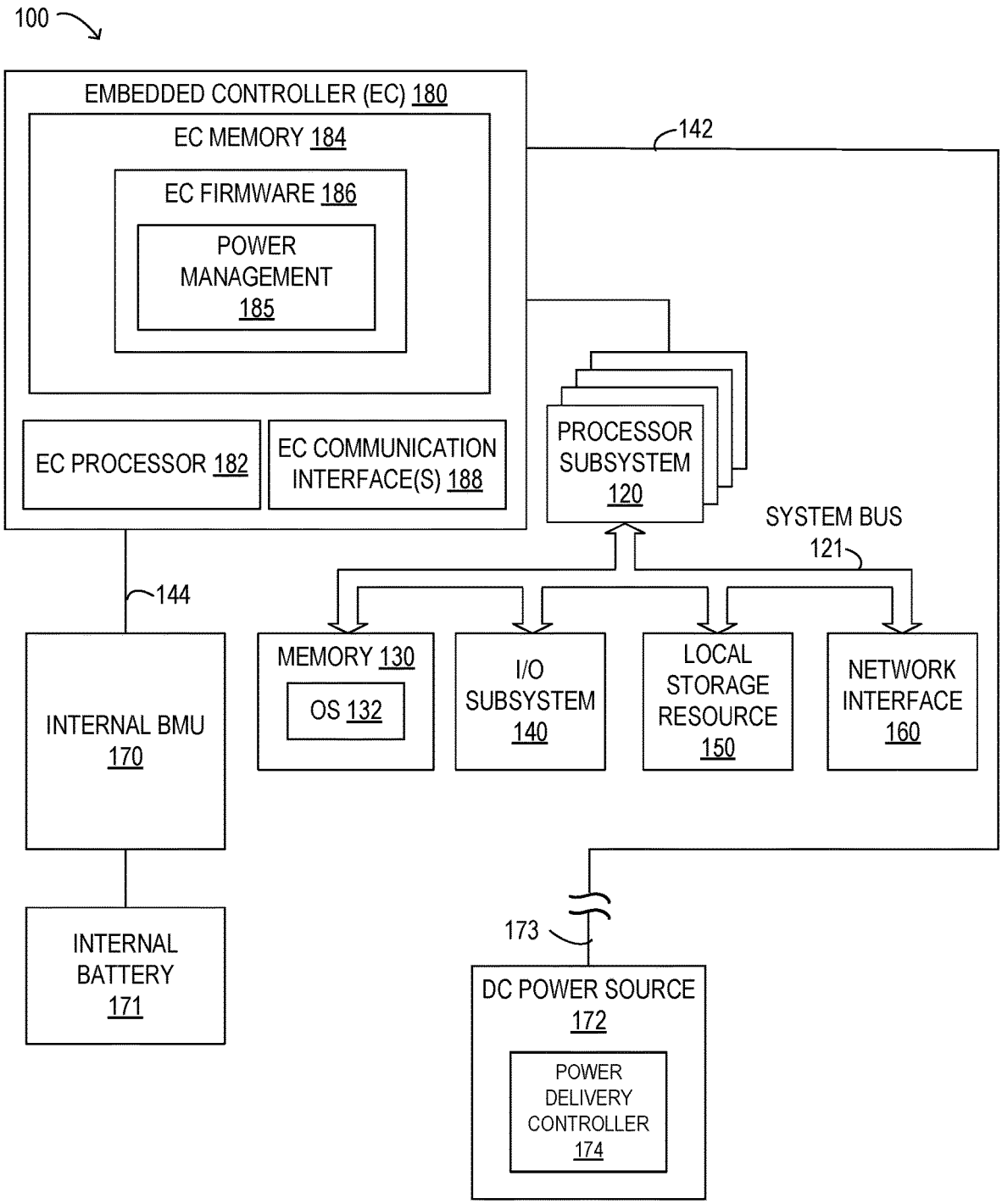
FIG. 1 is a block diagram illustrating selected elements of an embodiment of an information handling system that is coupled to a power source by a detachable reversable power cable.

In the following description, details are set forth by way of example to facilitate discussion of the disclosed subject matter. It should be apparent to a person of ordinary skill in the field, however, that the disclosed embodiments are exemplary and not exhaustive of all possible embodiments.

For the purposes of this disclosure, an information handling system may include an instrumentality or aggregate of instrumentalities operable to compute, classify, process, transmit, receive, retrieve, originate, switch, store, display, manifest, detect, record, reproduce, handle, or utilize various forms of information, intelligence, or data for business, scientific, control, entertainment, or other purposes. For example, an information handling system may be a personal computer, a PDA, a consumer electronic device, a network storage device, or another suitable device and may vary in size, shape, performance, functionality, and price. The information handling system may include memory, one or more processing resources such as a central processing unit (CPU) or hardware or software control logic. Additional components or the information handling system may include one or more storage devices, one or more communications ports for communicating with external devices as well as various input and output (I/O) devices, such as a keyboard, a mouse, and a video display. The information handling system may also include one or more buses operable to transmit communication between the various hardware components.

For the purposes of this disclosure, computer-readable media may include an instrumentality or aggregation of instrumentalities that may retain data and instructions for a period of time. Computer-readable media may include, without limitation, storage media such as a direct access storage device (e.g., a hard disk drive or floppy disk), a sequential access storage device (e.g., a tape disk drive), compact disk, CD-ROM, DVD, random access memory (RAM), read-only memory (ROM), electrically erasable programmable read-only memory (EEPROM), and flash memory (SSD); as well as communications media such wires, optical fibers, microwaves, radio waves, and other electromagnetic or optical carriers; or any combination of the foregoing.

Portable information handling systems exhibit a wide variety of configurations available from multiple vendors and may include any of a wide variety of accessories. These accessories often include a DC power adapter for supplying electrical power from a power source to the information handling system for operation and/or for charging an internal battery of the information handling system. DC power source adapters of different types may have different physical attributes (e.g., different sizes, shapes, or connector types), different electrical characteristics (e.g., different voltage profiles), or different power delivery capabilities and may adhere to different power delivery protocols.

As described in more detail herein, in at least some embodiments of the present disclosure a detachable reservable power cable may include a respective LED at each end of the cable. However, when in use, the LED on the source-side connector of the cable may be turned off and only the LED on the sink-side connector may be turned on. The disclosed techniques for LED control for a reversable power cable leverage existing configuration channel signals and wires to drive the sink-side LED without impacting normal power-delivery-related communications.

In some embodiments, Particular embodiments are best understood by reference to FIGS. 1, 2, 3A-3D, 4A-4B, 5, and 6, wherein like numbers are used to indicate like and corresponding parts.

Turning now to the drawings, FIG. 1 illustrates a block diagram depicting selected elements of an embodiment of portable information handling system 100 that is coupled to a DC power source by a detachable reversable power cable. It is noted that FIG. 1 is not drawn to scale but is a schematic illustration. In various embodiments, portable information handling system 100 may represent different types of portable devices. A portable device may generally be any device that a user may carry for handheld use and that includes a processor. Typically, portable devices are powered using a rechargeable battery. Examples of portable information handling system 100 may include laptop computers, notebook computers, netbook computers, tablet computers, and 2-in-1 tablet laptop combination computers, among others. In some instances, portable information handling system 100 may represent certain personal mobile devices, and may further include examples such as media players, personal data assistants, digital cameras, cellular phones, cordless phones, smart phones, and other cellular network devices.

As shown in FIG. 1, components of information handling system 100 may include, but are not limited to, a processor subsystem 120, which may comprise one or more processors, and a system bus 121 that communicatively couples various system components to processor subsystem 120 including, for example, a memory 130, an I/O subsystem 140, local storage resource 150, and a network interface 160. Also shown within information handling system 100 is embedded controller 180 and an internal battery management unit (BMU) 170 that manages an internal battery 171. Furthermore, information handling system 100 is shown removably coupled to a DC power input 173 that may supply electrical power for operation of information handling system 100, including for charging internal battery 171, received from a DC power source 172, such as an external battery or a power adapter. As illustrated in FIG. 1, DC power source 172 may include a power delivery controller 174, which may include logic and/or circuitry operable to negotiate a power delivery contract, among other functions. In various embodiments, power delivery controller 174 may be implemented by program instructions executing on a local processor or microcontroller, by dedicated hardware circuitry, or by any combination of hardware and software elements to perform the functionality of power delivery controller 174, as described herein. In various embodiments, to supply DC power over reversable power cable 142, DC power source 172 may include a battery, an AC-DC converter, or both.

As depicted in FIG. 1, processor subsystem 120 may comprise a system, device, or apparatus operable to interpret and execute program instructions and process data, and may include a microprocessor, microcontroller, digital signal processor (DSP), application specific integrated circuit (ASIC), or another digital or analog circuitry configured to interpret and execute program instructions and process data. In some embodiments, processor subsystem 120 may interpret and execute program instructions and process data stored locally (e.g., in memory 130). In the same or alternative embodiments, processor subsystem 120 may interpret and execute program instructions and process data stored remotely (e.g., in a network storage resource).

In FIG. 1, system bus 121 may represent a variety of suitable types of bus structures, e.g., a memory bus, a peripheral bus, or a local bus using various bus architectures in selected embodiments. For example, such architectures may include, but are not limited to, Micro Channel Architecture (MCA) bus, Industry Standard Architecture (ISA) bus, Enhanced ISA (EISA) bus, Peripheral Component Interconnect (PCI) bus, PCI-Express bus, HyperTransport (HT) bus, and Video Electronics Standards Association (VESA) local bus.

Also in FIG. 1, memory 130 may comprise a system, device, or apparatus operable to retain and retrieve program instructions and data for a period of time (e.g., computer-readable media). Memory 130 may comprise random access memory (RAM), electrically erasable programmable read-only memory (EEPROM), a PCMCIA card, flash memory, magnetic storage, opto-magnetic storage or a suitable selection or array of volatile or non-volatile memory that retains data after power is removed. In FIG. 1, memory 130 is shown including an operating system (OS) 132, which may represent an execution environment for portable information handling system 100. Operating system 132 may be UNIX or be based on UNIX (e.g., a LINUX variant), one of a number of variants of Microsoft Windows® operating systems, a mobile device operating system (e.g., Google Android™ platform, Apple® iOS, among others), an Apple® MacOS operating system, an embedded operating system, a gaming operating system, or another suitable operating system.

In FIG. 1, local storage resource 150 may comprise computer-readable media (e.g., hard disk drive, floppy disk drive, CD-ROM, and other type of rotating storage media, flash memory, EEPROM, or another type of solid state storage media) and may be generally operable to store instructions and data, and to permit access to stored instructions and data on demand.

In FIG. 1, network interface 160 may be a suitable system, apparatus, or device operable to serve as an interface between information handling system 100 and a network (not shown). Network interface 160 may enable information handling system 100 to communicate over the network using a suitable transmission protocol or standard. In some embodiments, network interface 160 may be communicatively coupled via the network to a network storage resource (not shown). The network coupled to network interface 160 may be implemented as, or may be a part of, a storage area network (SAN), personal area network (PAN), local area network (LAN), a metropolitan area network (MAN), a wide area network (WAN), a wireless local area network (WLAN), a virtual private network (VPN), an intranet, the Internet or another appropriate architecture or system that facilitates the communication of signals, data and messages (generally referred to as data). The network coupled to network interface 160 may transmit data using a desired storage or communication protocol, including, but not limited to, Fibre Channel, Frame Relay, Asynchronous Transfer Mode (ATM), Internet protocol (IP), other packet-based protocol, small computer system interface (SCSI), Internet SCSI (iSCSI), Serial Attached SCSI (SAS) or another transport that operates with the SCSI protocol, advanced technology attachment (ATA), serial ATA (SATA), advanced technology attachment packet interface (ATAPI), serial storage architecture (SSA), integrated drive electronics (IDE), or any combination thereof. The network coupled to network interface 160 or various components associated therewith may be implemented using hardware, software, or any combination thereof.

In information handling system 100, I/O subsystem 140 may comprise a system, device, or apparatus generally operable to receive and transmit data to or from or within information handling system 100. I/O subsystem 140 may represent, for example, a variety of communication interfaces, graphics interfaces, video interfaces, user input interfaces, and peripheral interfaces. In various embodiments, I/O subsystem 140 may be used to support various peripheral devices, such as a touch panel, a display adapter, a keyboard, an accelerometer, a touch pad, a gyroscope, or a camera, among other examples. In some implementations, I/O subsystem 140 may support so-called 'plug and play' connectivity to external devices, in which the external devices may be added or removed while portable information handling system 100 is operating.

In particular embodiments, embedded controller 180 may support one or more power busses that carry and distribute electrical power to and from portable information handling system 100. In some embodiments, a power bus carried over a detachable reversable power cable 142 may represent a data bus that also carries and distributes electrical power to and from portable information handling system 100. For example, a DC power input 173 received from DC power source 172 over reversable power cable 142 may be routed via a DC power connection 144 to internal BMU 170 for purposes of charging internal battery 171 or otherwise powering portable information handling system 100.

In various embodiments, a power bus carried over reversable power cable 142 may represent a variable power bus that supports different levels of direct current (DC) power that may be provided to certain peripherals connected to I/O subsystem 140. In certain embodiments, a variable power bus may be implemented according to an industry standard, such as a USB Universal Serial Bus (USB), which is developed and supported by the USB Implementers Forum, Inc. (USB IF, www.usb.org). In particular, a variable power bus carried over reversable power cable 142 may be implemented as a USB Type-C bus that may support different USB devices, such as USB Type-C devices with USB Type-C connectors. Accordingly, the variable power bus may support device detection, interface configuration, communication, and power delivery mechanisms according to the USB Type-C standard. The USB Type-C connector system allows the transport of data and electrical power (in the form of DC power) between various USB devices that are connected using USB Type-C ports and USB Type-C connectors. A USB device may be an information handling system, a peripheral device, or a power device, among other types of USB devices, and may support more than one USB standard or generation, such as USB 1.0, USB 2.0, USB 3.0, USB 3.1, or other versions. Furthermore, USB devices may also support one or more types of physical USB ports and corresponding connectors (i.e., receptacles and plugs), such as Type-A, Type-A SuperSpeed, Type-B, Type-B SuperSpeed, Mini-A, Mini-B, Micro-A, Micro-B, Micro-B SuperSpeed, and Type-C (also referred to as USB Type-C herein), among other variants. In one example, reversable power cable 142 may be a USB 3.1 Type-C cable that provides electronic functionality using an integrated semiconductor device with an identification function based on a configuration data channel and vendor-defined messages (VDMs) from a USB Power Delivery specification published by USB IF (http://www.usb.org/developers/powerdelivery/). For example, reversable power cable 142 may include electronic marking circuitry in the connectors at each end of the cable. The USB Power Delivery specification defines four standardized voltage levels (+5V DC, +9V DC, +15V DC, and +20V DC), while power supplies may provide electrical power from 0.5 watts to 100 watts.

A USB device, such as a USB Type-C device, may provide multiple power ports that can individually transfer power in either direction and may accordingly be able to operate as a power source device, a power sink device, or both (dual-role power device). A USB device operating as a dual-role power device may operate as a power source or a power sink depending on what kinds of other USB devices are connected. In addition, each of the power ports provided by a USB device may be a dual-role power port that is able to operate as either a power source port or a power sink port. For example, a USB Type-C bus carried over reversable power cable 142 may support power delivery from a power source port of a power source USB device to a power sink port of a power sink USB device, while simultaneously supporting bidirectional USB data transport. The power source port of the power source USB device and the power sink port of the power sink USB device form a power port pair. Each of the other power ports provided by the USB device may form other power port pairs of other USB dual-role power devices. In some embodiments, DC power source 172 may operate as a power source for information handling system 100, which operates as a power sink, over reversable power cable 142.

According to the USB Power Delivery Specification, USB Type-C devices may perform a negotiation process to negotiate and establish a power contract for a particular power port pair that specifies a level of DC power that is transferred using USB. For example, a USB Type-C device may negotiate a power contract with another USB device for a level of DC power that is supported by a power port pair of both devices, where one power port is a power source port of the USB Type-C device and the other power port is a power sink port of the other USB device. The power contract for power delivery and consumption may represent an agreement reached between the power source device and the power sink device for the power port pair. While operating in Power Delivery mode, the power contract for the power port pair will generally remain in effect unless altered by a re-negotiation process, a USB soft reset, a USB hard reset, a removal of power by a power source, a failure of the power source, or a USB role swap (such as between power source and power sink devices), as specified in detail by USB IF. When a particular power contract is in place, additional power contracts can be established between another power port of the power source device and a power port of another power sink device.

According to the USB Power Delivery specification, the negotiation process may begin with the power source device detecting an attachment of a USB device operating as a power sink to a power port of the power source device. In response to the detection of the attachment at the respective USB ports, the power source device may communicate a set of supported capabilities including power levels, voltage levels, current levels, and direction of power flow of the power port of the power source device by sending the set of supported capabilities to the power sink over the USB connection. In response to receiving the set of supported capabilities, the power sink device may request one of the communicated capabilities by sending a request message to the power source device. In response to receiving the request message, the power source device may accept the request by sending an accept message and by establishing a power source output corresponding to the request. The power contract for the power port pair may be considered established and in effect when the power source device sends the accept message to the power sink device, which ends the negotiation process. A re-negotiation process may occur in a similar manner when a power contract is already in effect.

Also shown in FIG. 1 is embedded controller (EC) 180, which may include EC processor 182 as a second processor included within portable information handling system 100 for certain management tasks, including supporting communication and providing various functionality with respect to internal BMU 170. Thus, EC processor 182 may have access to EC memory 184, which may store EC firmware 186, representing instructions executable by EC processor 182. As shown, EC firmware 186 includes power management 185, which may represent executable code for managing external DC power sources, such as DC power source 172, as well as for controlling various operating parameters of internal battery 170, as disclosed herein. In some embodiments, EC firmware 186 may include pre-boot instructions executable by EC processor 182. For example, EC firmware 186 may be operable to prepare information handling system 100 to boot by activating various hardware components in preparation of launching an operating system for execution. Accordingly, in some embodiments, EC firmware 186 may include a basic input/output system (BIOS). In certain embodiments, EC firmware 186 includes a Unified Extensible Firmware Interface (UEFI) according to a specification promulgated by the UEFI Forum (uefi.org). Embedded controller 180 may execute EC firmware 186 on EC processor 182 even when other components in information handling system 100 are inoperable or are powered down. Furthermore, EC firmware 186 may be in control of EC communication interface(s) 188, which may represent one or more input/output interfaces or signals that embedded controller 180 can use to communicate with other elements of information handling system 100, such as processor subsystem 120 or I/O subsystem 140, among others.

In the illustrated embodiment, embedded controller 180 may be responsible for managing electrical power connections between internal or external power sources and other portions of portable information handling system 100. For example, embedded controller 180 may include logic or circuitry to implement a power controller. In other embodiments, power control may be implemented by a separate power controller external to embedded controller 180. For example, a power bus may supply electrical power to portable information handling system 100 over reversable power cable 142, in which case embedded controller 180, or a separate power controller, may determine whether the electrical power is used to charge internal battery 171 or to directly power portable information handling system 100. In the illustrated embodiment, DC power and control 144 may represent suitable connections between embedded controller 180 and internal BMU 170, for example. This may include connections for providing data obtained from internal battery 171 (e.g., temperature, battery state, state of charge, etc.) which may serve as inputs for various power management and control operations.

As illustrated in FIG. 1, portable information handling system 100 may include a battery management unit (BMU) 170 that controls operation of internal battery 171. For example, BMU 170 may be configured to implement internal battery management. In particular implementations, BMU 170 may be embedded within a respective battery whose operation BMU 170 controls. For example, internal BMU 170 within portable information handling system 100 may control operation of an internal battery 171. In certain embodiments, BMU 170 may include a processor and memory (not shown). The memory may store instructions executable by the processor to perform one or more methods for performing various battery management functions. For example, BMU 170 may monitor information associated with, and control charging operations of, internal battery 171. In operation, BMU 170 may control operation of internal battery 171 to enable sustained operation, such as by protecting internal battery 171. Protection of internal battery 171 by BMU 170 may comprise preventing internal battery 171 from operating outside of safe operating conditions, which may be defined in terms of certain allowable voltage and current ranges over which internal battery 171 can be expected to operate without causing self-damage. For example, the BMU 170 may modify various parameters in order to prevent an over-current condition (whether in a charging or discharging mode), an over-voltage condition during charging, an under-voltage condition while discharging, or an over-temperature condition, among other potentially damaging conditions.

As shown in FIG. 1, DC power source 172 may be designed to removably couple to portable information handling system 100 using reversable power cable 142. For example, reversable power cable 142 may include power connections for electrically coupling a DC power source to portable information handling system 100 as an external load on DC power source 172. In certain embodiments, reversable power cable 142 may carry a variable power bus that also includes a communication link to enable a DC power source 172 to communicate with portable information handling system 100. For example, a DC power source 172 may communicate power delivery capabilities of the DC power source 172 to portable information handling system 100 over a communication link within a variable power bus carried over reversable power cable 142. As noted above, in particular embodiments, reversable power cable 142 may be compatible with USB Type-C and may be implemented according to USB Type-C and USB Power Delivery specifications promulgated by USB IF.

The output voltage behavior of a USB Type-C AC adapter differs from that of AC adapters with traditional barrel-type connectors. For example, when a USB Type-C AC adapter is connected to AC line power, the output voltage is off, whereas when a traditional barrel-type adapter is connected to AC line power, the voltage is powered up and appears at the end of the adapter output cable. In this condition, whether or not the adapter is connected to a power sink device, the expected behavior of an indicator LED on the adapter output cable is to be "ON" as an indication that the adapter has AC line power and is functional. With a traditional barrel-type adapter, the LED can simply be powered from the source and ground wires of the adapter output cable. However, with a USB Type-C AC adapter, a dedicated wire with 5V must be added to the adapter output cable to supply power to any LEDs on the cable connectors.

On a detachable reversable power cable, there may be a respective LED on the connector at each end of the cable. Existing techniques for providing power to the two LEDs may exceed green-friendly, no-load power specifications for the systems in which they are deployed. For example, the power adapter may experience a greater power loss when both LEDs are turned on at the same time. The use of white LEDs on the reversable power cable, which may draw more power than LEDs of other colors, may compound this issue, making it difficult, if not impossible to meet US Department of Energy (DoE) standards and/or the European Union (EU) Code of Conduct (CoC) for external power supplies if the two LEDs are turned on at the same time.

In at least some embodiments of the present disclosure, refraining from turning on either of the LEDs when the reversable power cable is not connected to a DC power source, such as an external battery or a power adapter, and only turning on a sink-side LED when the reversable power cable is connected to the power source, may reduce power consumption from the power source, allowing the system to meet applicable no-load, DoE, and EU CoC standards for external power supplies.

In at least some embodiments, a USB Type-C AC adapter may include a MOSFET (i.e., a blocking MOSFET) to block the internal voltage of the adapter from the source/ground wires of a reversable power cable connected to the adapter output until the cable is attached to a power sink. The dedicated 5V LED wire may be connected in front of the blocking MOSFET to provide power to an LED on a connector at one end of the reversable power cable. Once the adapter is connected to a power sink, it may negotiate the delivery of power to the power sink, at which time the blocking MOSFET may be turned on allowing power onto a source wire on the reversable power cable.

In at least some embodiments, a configuration channel (CC) wire on the reversable power cable may be utilized to provide power at very short debounce time to turn on the sink-side LED when a connection between the source-side connector on the cable and the power source is detected. Subsequently, after the debounce time, the connection between the CC signal and an LED switch for the sink-side LED may be cut off, after which power may be provided to the LED over the Vbus wire without affecting communication over the CC wire. For example, a USB Type-C connector includes two configuration channel pins, CC1 and CC2. These pins may be used to connect to the either the CC wire or the Vconn wire in a USB Type-C cable and they support either function, as determined upon connection of the cable. The CC wire may be used for cable orientation detection, USB Type-C current capability advertisement and detection, and USB2.0 BMC communication, while the Vconn wire may be used to power active or electronically marked cables. Resistors are attached to the CC pins in various configurations depending on whether the application is a source-side port, a sink-side port, or an electronically marked/active cable. For example, an Rp pull-up resistor on source-side port may be connected to both the CC1 and CC2 pins, and may be pulled up to either 3.3V or 5.0V. The value of the resistor may advertise the current supplying capability of the power source. A sink-side port may connect a valid Rd pull-down resistor to GND to both the CC1 and CC2 pins. An active cable may connect an Ra resistor from the Vconn pin to GND.

The CC1 and CC2 pins may be monitored to perform cable attachment and detachment detection, cable orientation detection, and USB Type-C current capability advertisement for a USB Type-C cable. For example, a cable attachment is detected when either of the CC1 or CC2 pins detects a valid Rp/Rd connection. For a standard USB connection, only one of the CC1/CC2 pins may detect a valid Rp/Rd connection, not both. A cable orientation detection may be performed as follows: if the CC1 pin detects a valid Rp/Rd connection, then the cable may be considered to be in an "unflipped" orientation at that port. However, if the CC2 pin detects a valid Rp/Rd connection, then the cable may be considered to be in a "flipped" orientation at that port.

It at least some embodiments, the connectors on each end of a reversable power cable may include electronic marking circuitry. For example, the reversable power cable may be USB Type-C active cable that is packaged with a respective integrated circuit (IC) comprising electronic marking circuitry in the connectors at each end of the cable and that uses a USB Power Delivery protocol to identify various properties of the cable. Including an electronic marking IC in both connectors may allow both electronic marking ICs to be powered from the Vconn pin at each connector, reducing the number of wires required in the cable. In such embodiments, since only the power source, and not the power sink, will provide a Vconn voltage, only one of the electronic marking ICs will be active at a time.

Figure 2:
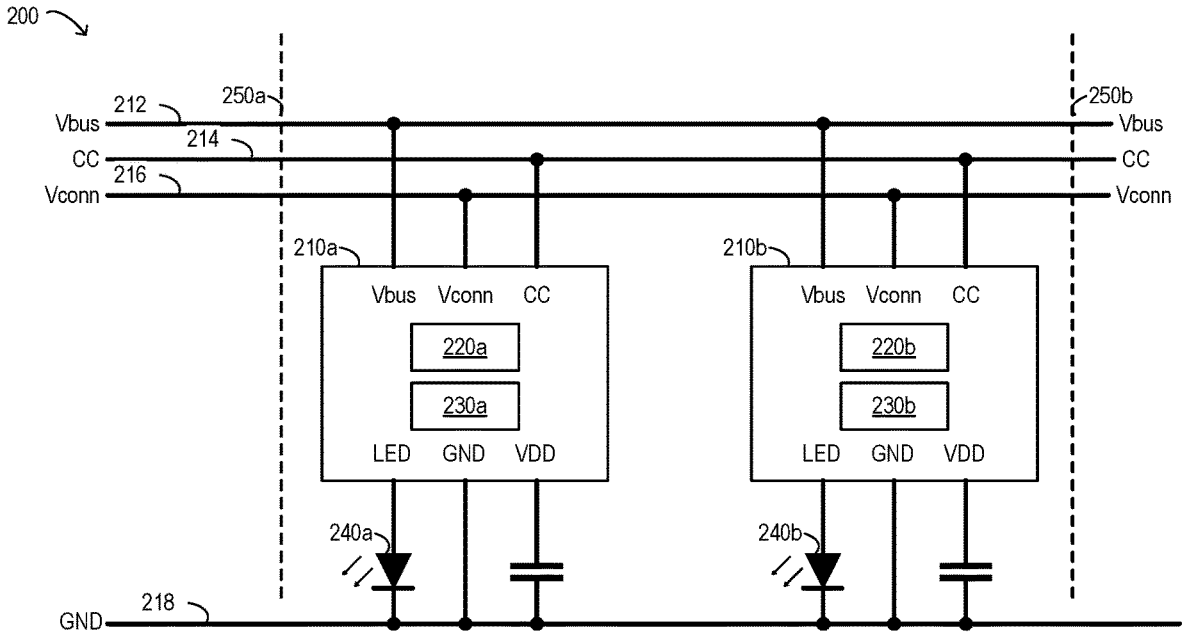
FIG. 2 is a block diagram illustrating selected elements of an embodiment of a detachable reversable power cable.

FIG. 2 is a block diagram illustrating selected elements of an embodiment of a detachable reversable power cable. It is noted that FIG. 2 is not drawn to scale but is a schematic illustration. In the illustrated embodiment, reversable power cable 200 includes a respective connector 210 at each end of the cable and carries signals representing a power bus, shown as Vbus 212, ground 218, and two configuration channels. The configuration channels are shown as CC 214, which may correspond to the CC1 configuration channel, and Vconn 216, which may correspond to the CC2 channel. As illustrated in this example, in at least some embodiments, each of the connectors 210 of reversable power cable 200 may include electronic marker circuitry 220 and an LED driver 230. Each connector 210 may include, or may be coupled to, a respective LED 240. In other words, the reversable power cable 200 may include an LED 240 on each end of the cable. In the example embodiment illustrated in FIG. 2, connector 210*a* may be a source-side connector with which reversable power cable 200 is coupled to a power source, such as an external battery or a power adapter, on the left side of dashed line 250*a*. In this example, connector 210*b* may be a sink-side connector with which reversable power cable 200 is coupled to a power sink, such as an information handling system, on the right side of dashed line 250*b*.

FIGS. 3A through 3D are block diagrams illustrating selected elements of an embodiment of a system 300 including a power source, a power sink, and a detachable reversable power cable. It is noted that FIGS. 3A through 3D are not drawn to scale but are schematic illustrations. In the illustrated embodiment, system 300 includes a power source 310, such as an external battery or a power adapter, a power sink 330, such as an information handling system, and a reversable power cable that includes a source-side connector assembly 320*a* and a sink-side connector assembly 320*b*. As shown in FIGS. 3A through 3D, the source-side connector assembly 320*a* and the sink-side connector assembly 320*b* are identical, allowing either end of reversable power cable to be connected to power source 310 or to power sink 330, at different times.

In the illustrated embodiment, power source 310 includes a power delivery controller 174, which may include logic and/or circuitry operable to negotiate a power delivery contract, among other functions. In various embodiments, power delivery controller 174 may be implemented by program instructions executing on a local processor or microcontroller, by dedicated hardware circuitry, or by any combination of hardware and software elements to perform the functionality of power delivery controller 174, as described herein. Power source 310 also includes respective ports or pins to be coupled to various wires within the reversable power cable, including a Vbus port/pin to which Vbus signal 212 is connected, a CC1 port/pin to which CC signal 214 is connected, a CC2 port/pin to which Vconn signal 216 is connected, and a ground port/pin to which ground signal 218 is connected.

In the illustrated embodiment, power sink 330 includes Rd pull-down resistor 331 that pulls CC signal 214 to ground. Power sink 330 also includes respective ports or pins to be coupled to various wires within the reversable power cable, including a Vbus port/pin to which Vbus signal 212 is connected, a CC1 port/pin to which CC signal 214 is connected, and a ground port/pin to which ground signal 218 is connected. In the illustrated embodiment, only power source 310 provides Vconn signal 216. AS shown, CC2 port/pin of power sink 3310 provides power signal 333 to various elements of sink-side connector 320*b*. In various embodiments, power sink 330 may be an information handling system that also includes any or all of the elements of information handling system 100 illustrated in FIG. 1. This may include, for example, an embedded controller 180 operable to manage electrical power connections between internal or external power sources and other portions of power sink 330 (not shown in FIGS. 3A-3D).

In the illustrated embodiment, each connector 320 includes a respective LED switch, a respective resister Ra resistor from the Vconn pin to ground, and a respective switch controller, among other elements. For example, connector 320*a* includes LED switch 323, resister Ra 321, and switch controller 325. Similarly, connector 320*b* includes LED switch 324, resister Ra 322, and switch controller 326.

Figure 3A:
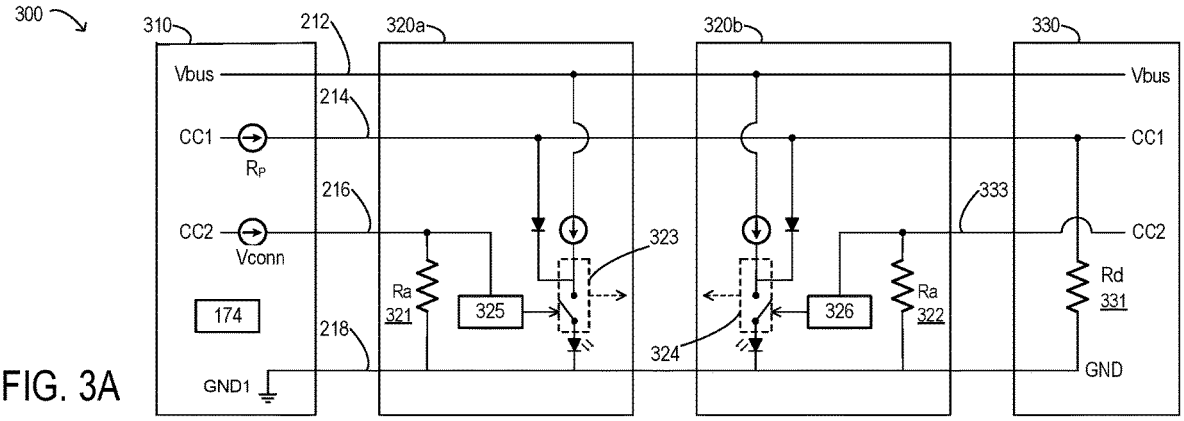
FIGS. 3A through 3D are block diagrams illustrating selected elements of an embodiment of a system including a power source, a power sink, and a detachable reversable power cable.

FIG. 3A illustrates the state of system 300 independent of the performance of the LED control operations described herein. For example, system 300 is illustrated in a state in which the reversable power cable is connected to both power source 310 and power sink 330. In practice, however, prior to the reversable power cable being connected to either power source 310 or power sink 330, the wires over which Vbus signal 214, CC signal 214, Vconn signal 216, Vconn signal 333, and ground signal 218 are carried on the reversable power cable are not connected to power source 310 and are not connected to power sink 330, and both LED switch 323 and LED switch 324 may initially be on.

Figure 3B:
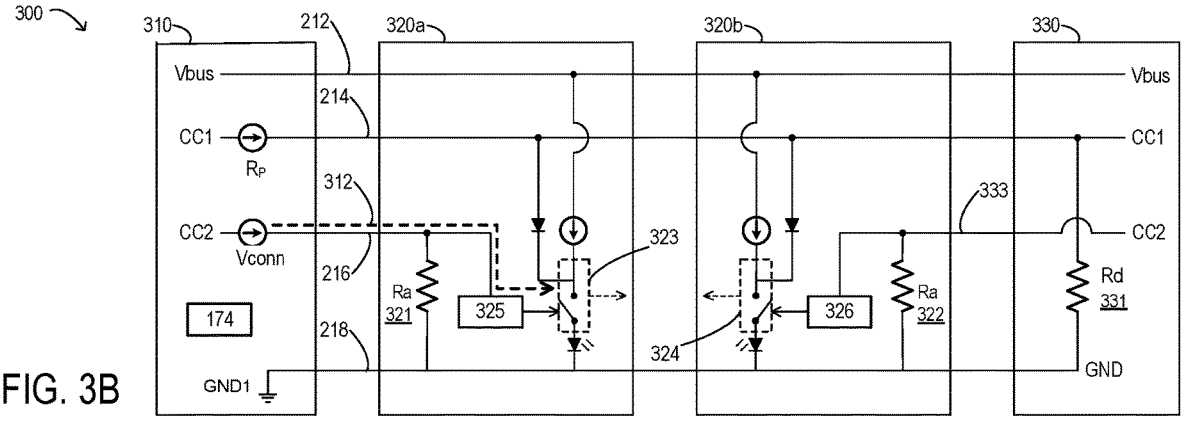

FIG. 3B illustrates the state of system 300 when a first pulse 312 is triggered by power delivery controller 174. For example, power delivery controller 174 may detect the attachment of source-side connector 320*a* of the reversable power cable to power source 310 by detecting the presence of resister Ra 321. In response to detecting the attachment of source-side connector 320*a* of the reversable power cable to power source 310, power delivery controller 174 may send a pulse on the Vconn signal, shown as pulse 312, to turn off source-side LED switch 323, thus disabling the LED in source-side connector 320*a*.

Figure 3C:
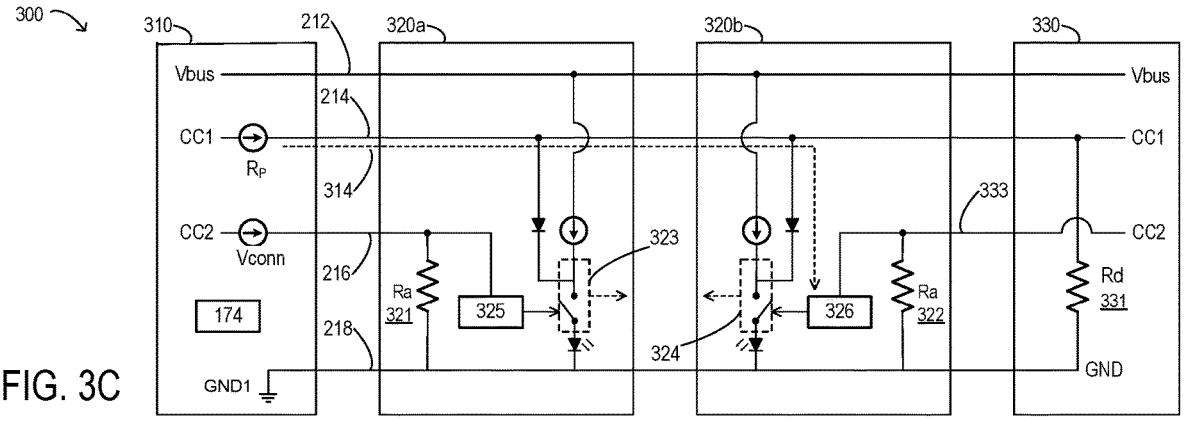

FIG. 3C illustrates the state of system 300 when a second pulse 314 is triggered by power delivery controller 174. For example, in response to detecting the attachment of source-side connector 320*a* of the reversable power cable to power source 310, and subsequent to triggering the first pulse 312, power delivery controller 174 may send a pulse on CC signal 214, shown as pulse 314, to drive the LEDs in both connectors 320 of the reversable power cable. However, because the first pulse 312 disabled the LED in source-side connector 320*a*, only the LED in sink-side connector 320*b* will be enabled by the second pulse 314.

Figure 3D:
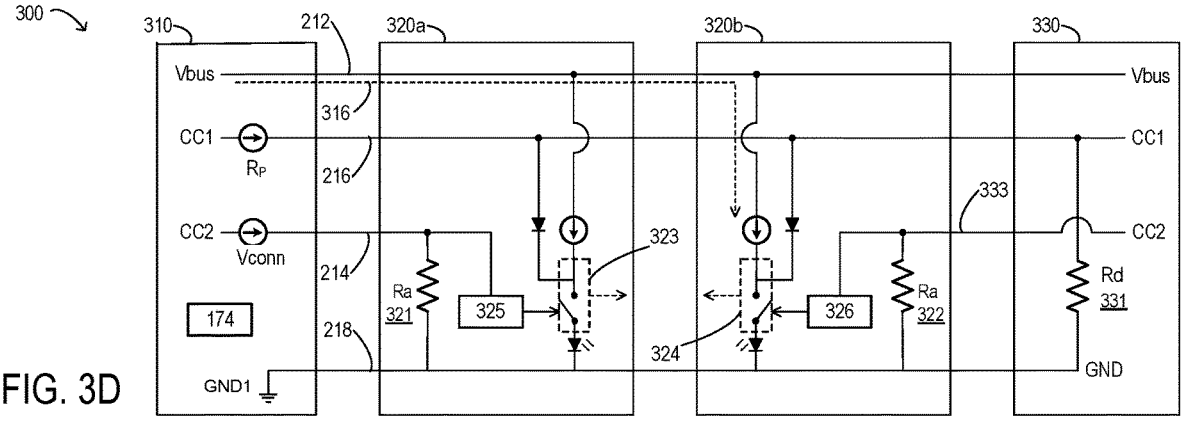

FIG. 3D illustrates the state of system 300 when power delivery controller 174 causes a modification of the driver path at LED switch 324 in sink-side connector 320*b* when the sink-side connector 320*b* of the reversable power cable is attached to power sink 330. For example, when the sink-side connector 320*b* of the reversable power cable is attached to power sink 330, power delivery controller 174 may detect the attachment by detecting the presence of resister Rd 331 on power sink 330. In response to detecting the attachment, power delivery controller 174 may switch the driving current for the LED in sink-side connector 320*b* from the CC 214 signal to the Vbus signal 212. More specifically, the Rp current provided by CC signal 214 may drop (e.g., from a current on the order of 330 uA) due to the presence of Rd resister 331 on power sink 330 (e.g., a resistance on the order of 5.1K ohm). After a brief debounce period (e.g., a debounce time on the order 120 ms), power delivery controller 174 may decouple CC signal 214 from the driver path of the LED in sink-side connector 320*b*, and couple the driver path of the LED in sink-side connector 320*b* to Vbus signal 212, as shown by connection 316. After completing the operations shown in FIGS. 3B through 3D, the electrical power for driving the LED in sink-side connector 320*b* will be provided by Vbus signal 212.

Note that while FIGS. 3A through 3D illustrate an example use case in which a reversable power cable is attached first to a power source 310, such as an external battery or a power adapter, and then to a power sink 330, in some scenarios a reversable power cable may be attached first to a power sink 330, such as an information handling system, and then to a power source 310, such as an external battery or a power adapter. In such scenarios, because the power sink 330 will not trigger a pulse on a Vconn signal to turn either of the LEDs in the connectors 320 at respective ends of the reversable power cable on or off even if the power sink 330 detects the attachment, no signal will drive either of the LEDs until and unless the reversable power cable is connected to a power source 310. In this example, the power sink 330 would not act as a power source to send an electronic marking command because the power sink 330 does not detect both an Rd resister and an Ra resister at the same time. Once the reversable power cable is also attached to the power source 310, the operations shown in FIGS. 3B through 3D may be performed, after which the electrical power for driving the LED in sink-side connector 320*b* will be provided by Vbus signal 212.

In at least some embodiments, subsequent to the reversable power cable being attached to both a power source 310 and a power sink 330, as described above, the cable may be detached from the power source 310 and/or from the power sink 330. If the reversable cable is first detached from the power source 310, the LED in the sink-side connector 320*b* will be turned off due to the loss of electrical power supplied by the Vbus signal, and the LED in the source-side connector 320*a* will be returned to its initial state. In other words, detaching the reversable power cable from the power source 310 returns the system to the same state described above in which the reversable power cable is first attached to the power sink 330 and then to the power source 310. If the reversable power cable is first detached from the power sink 330, the driver path for the LED in the sink-side connector 320*b* will be switched back to the CC signal 214 from the Vbus signal 212 and the LED in the source-side connector will remain disabled since the Vconn signal previously caused the LED driver in the source-side connector 320*a* to be blocked. In other words, detaching the reversable power cable from the power sink 330 returns the system to the same state described above in which the reversable power cable is first attached to the power source 310 and then to the power sink 330.

Figure 4A:
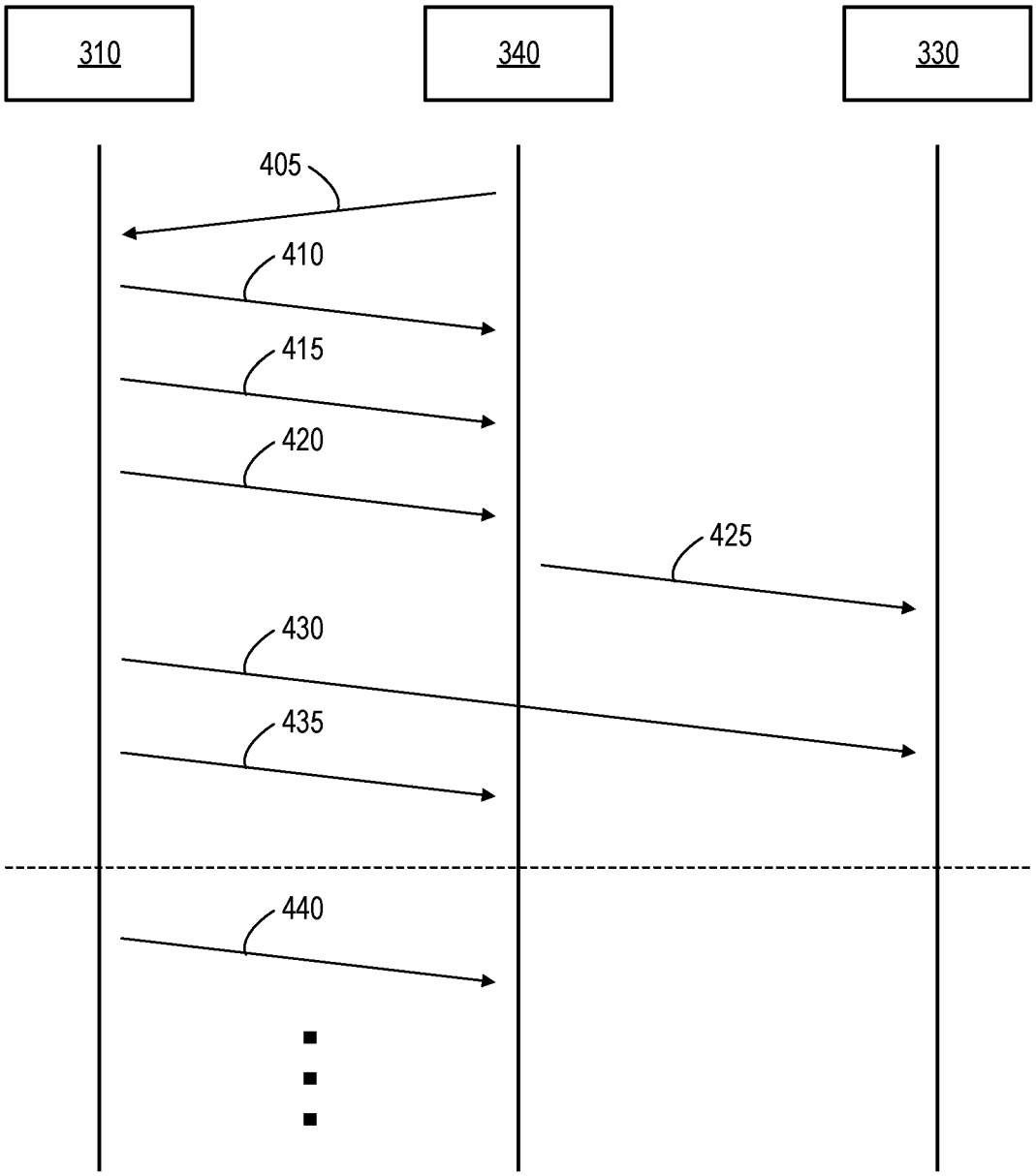
FIG. 4A illustrates, for an example embodiment, the exchange of selected control signals and other indicators to control LEDs on each end of a detachable reversable power cable when the cable is first connected to a power source and then to a power sink.

FIG. 4A illustrates, for an example embodiment, the exchange of selected control signals and other indicators to control LEDs on each end of a detachable reversable power cable 340 when cable 340 is first connected to a power source 310, such as an external battery or a power adapter, and then to a power sink 330, such as an information handling system. In FIG. 4A, cable 340 represents a reversable power cable including respective connectors 320 at opposite ends of cable 340 and including electronic marking circuitry in each connector 320.

In the illustrated example, indicator 405 represents the attachment of the connector 320 at a given end (i.e., an arbitrarily chosen first end) of reversable power cable 340 to the power source 310, and indicator 410 represents the detection of the attachment by the power source 310, such as by detecting, based on a change in the current on the Vconn signal, the presence of a resister Ra on the source-side connector 320.

Signal 415 represents a pulse on the Vconn signal at port/pin CC2 of power source 310 triggered by a power delivery controller on power source 310 to disable the source-side LED driver, as described herein. Signal 420 represents a pulse on the CC signal at port/pin CC1 of power source 310 triggered by the power delivery controller on power source 310 to turn on the sink-side LED driver, and the coupling of the driver path for the sink-side LED to the CC1 signal, as described herein.

Indicator 425 indicates the attachment of the connector 320 at the end of reversable power cable 340 opposite the arbitrarily chosen first end to the power sink 330. Indicator 430 represents the detection of the attachment by the power source 310, such as by detecting, based on a change in the current on the CC1 signal, the presence of a resister Rd on power sink 330, and the enabling of the blocking MOSFET on power source 310 to prevent the LED on the source-side connector 320 from turning on. Indicator 435 represents the modification of the driver path for the sink-side LED from the CC signal to the Vbus signal, as described herein. At this point, the LED control flow for reversable power cable 340 may be complete, at least until reversable power cable 340 is detached from either power source 310 or power sink 330.

In the illustrated example, signal 440 represents the identification of power source 310 using electronic marking, as described herein, after which the capabilities of power source 310 are communicated to power sink 330 and a power delivery contract is negotiated between power source 310 and power sink 330 (not shown in FIG. 4A).

Figure 4B:
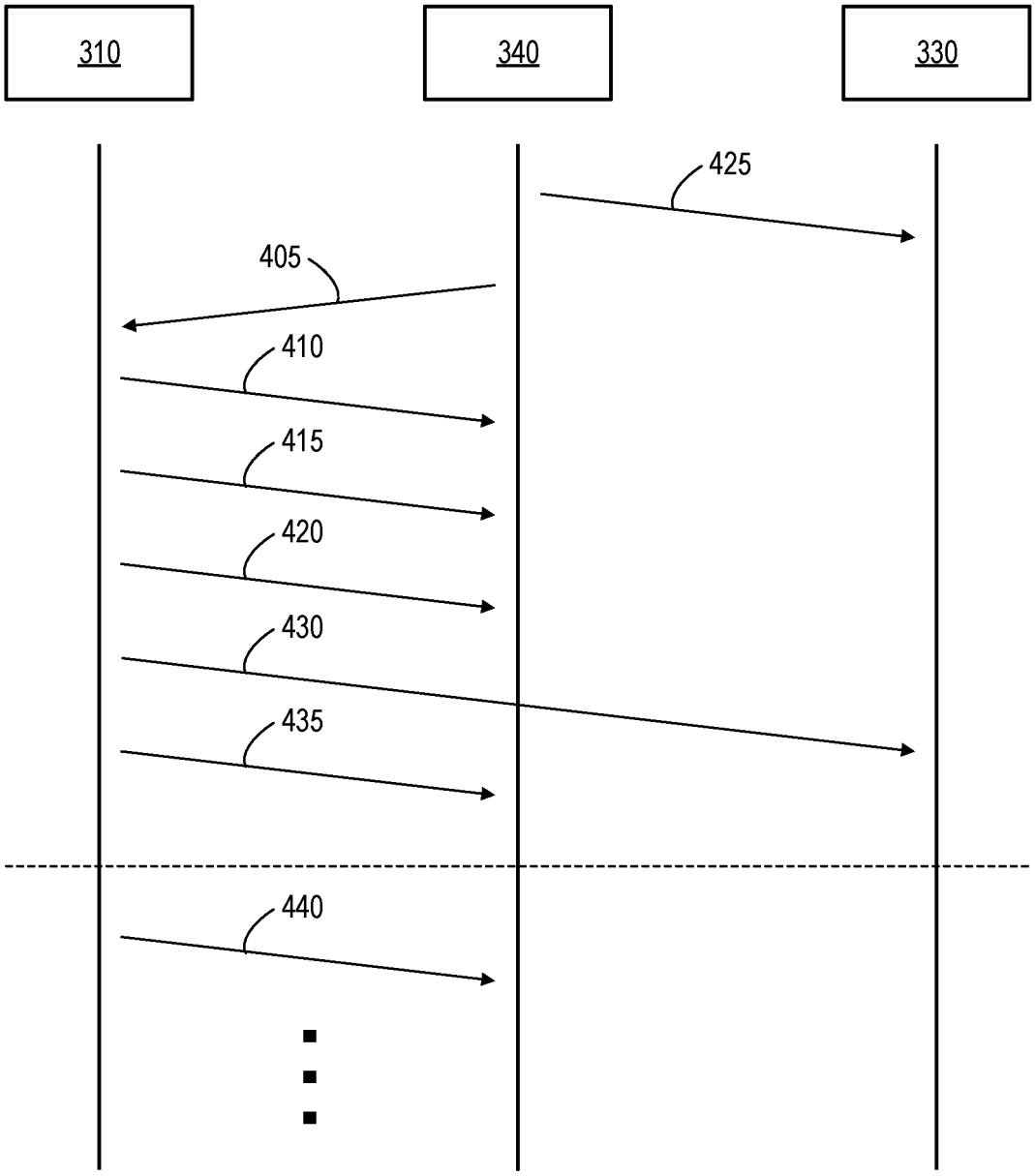
FIG. 4B illustrates, for an example embodiment, the exchange of selected control signals and other indicators to control LEDs on each end of a detachable reversable power cable when the cable is first connected to a power sink and then to a power source.

FIG. 4B illustrates, for an example embodiment, the exchange of selected control signals and other indicators to control LEDs on each end of a detachable reversable power cable 340 when cable 340 is first connected to a power sink 330, such as an information handling system, and then to a power source 310, such as an external battery or a power adapter. As in the example illustrated in FIG. 4B, cable 340 represents a reversable power cable including respective connectors 320 at opposite ends of cable 340 and including electronic marking circuitry in each connector 320.

In the illustrated embodiment, the control signals and other indicators exchanged are substantially similar to those illustrated in FIG. 4A and described above. However, the order in which the control signals and other indicators are exchanged is different. For example, in FIG. 4B, the first indicator shown is indicator 425, which indicates the attachment of the connector 320 at a given end (i.e., an arbitrarily chosen first end) of reversable power cable 340 to the power sink 330. In this example, because power sink 330 cannot trigger a pulse to drive the LEDs in either the sink-side connector or the source-side connector, both LEDs are off even after power sink 330 is attached to cable 340.

Following the attachment of power sink 330 to cable 340, indicator 405 represents the attachment of the connector 320 at the end of reversable power cable 340 opposite the arbitrarily chosen first end to the power source 310, and indicator 410 represents the detection of the attachment by the power source 310, such as by detecting, based on a change in the current on the Vconn signal, the presence of a resister Ra on the source-side connector 320.

Signal 415 represents a pulse on the Vconn signal at port/pin CC2 of power source 310 triggered by a power delivery controller on power source 310 to disable the source-side LED driver, as described herein. Signal 420 represents a pulse on the CC signal at port/pin CC1 of power source 310 triggered by the power delivery controller on power source 310 to turn on the sink-side LED driver, and the coupling of the driver path for the sink-side LED to the CC1 signal, as described herein.

Indicator 430 represents the detection of the attachment of the power source 310 to cable 340, such as by detecting, based on a measurement of the current on the CC1 signal, the presence of a resister Rd on power sink 330, and the enabling of the blocking MOSFET on power source 310 to prevent the LED on the source-side connector 320 from turning on. Indicator 435 represents the modification of the driver path for the sink-side LED from the CC signal to the Vbus signal, as described herein. At this point, the LED control flow for reversable power cable 340 may be complete, at least until reversable power cable 340 is detached from either power source 310 or power sink 330.

In the illustrated example, signal 440 represents the identification of power source 310 using electronic marking, as described herein, after which the capabilities of power source 310 are communicated to power sink 330 and a power delivery contract is negotiated between power source 310 and power sink 330 (not shown in FIG. 4A).

Figure 5:
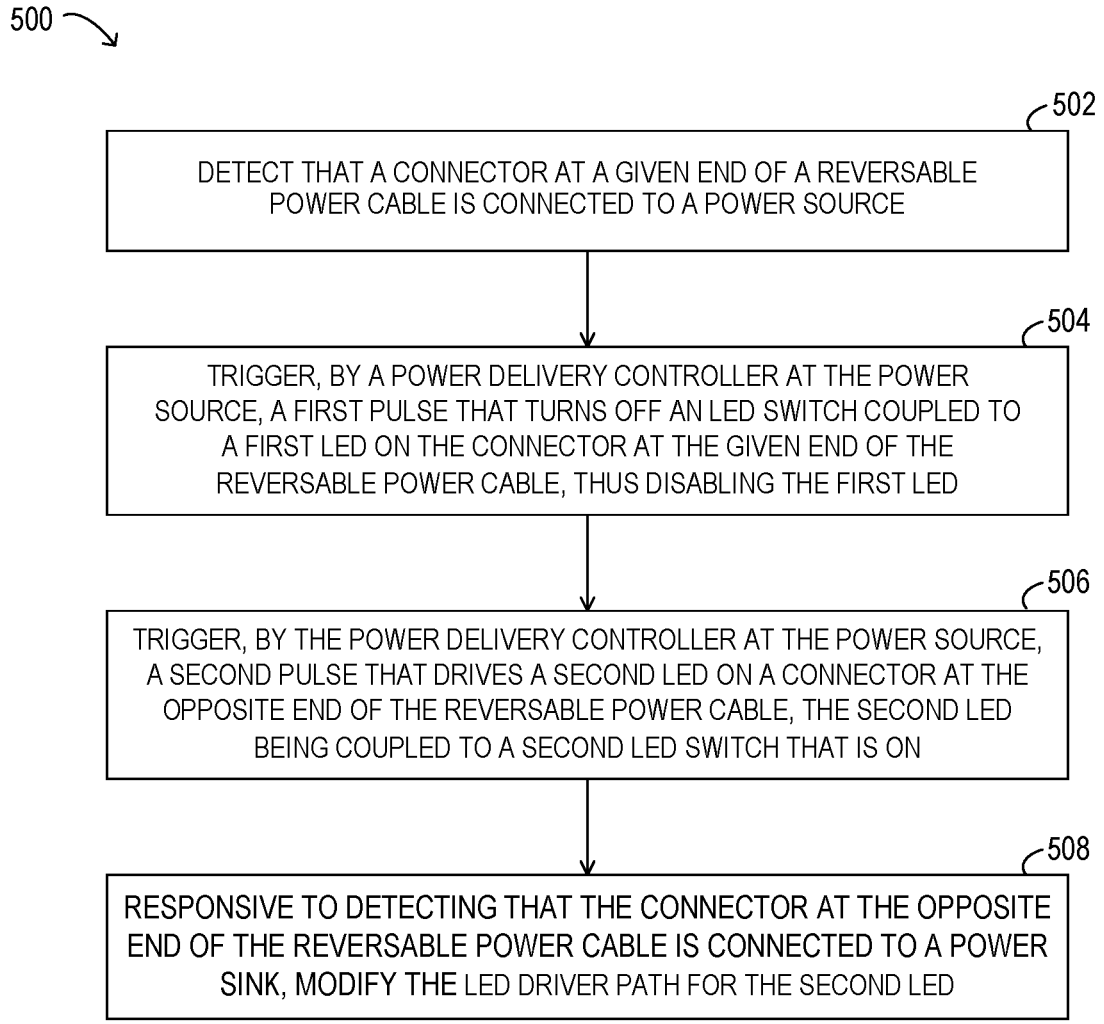
FIG. 5 is flow diagram illustrating selected elements of a method for LED control for a detachable reversable power cable of an information handling system.

Referring now to FIG. 5, selected elements of an embodiment of method 500 for LED control for a detachable reversable power cable of an information handling system, as described herein, is depicted in flowchart form. In certain embodiments, one or more operations of method 500 may be performed by a power delivery controller of a power source, such as power delivery controller 174 of DC power source 172 illustrated in FIG. 1 or power delivery controller 174 of power source 310 illustrated in FIGS. 3A through 3D. Method 500 may be performed repeatedly or continuously to control the LEDs of a reversable power cable when the reversable power cable is attached or re-attached to a power source and then to a power sink. It is noted that certain operations described in method 500 may be optional or may be rearranged in different embodiments.

Method 500 may begin, at 502, with detecting that a connector at a given end (i.e., an arbitrarily chosen first end) of a reversable power cable is connected to a power source, as described herein.

The method may include, at 504, triggering, by a power delivery controller at the power source, a first pulse that turns off an LED switch coupled to a first LED on the connector at the given end of the reversable power cable (i.e., the source-side connector), thus disabling the first LED. For example, the first pulse may be sent to the reversible power cable over the Vconn signal connected to the power source at the CC2 port/pin.

At 506, method 500 may include triggering, by the power delivery controller at the power source, a second pulse that drives a second LED on a connector at the opposite end (i.e., a second end opposite the arbitrarily chosen first end) of the reversable power cable (i.e., a sink-side connector), the second LED being coupled to a second LED switch that is on. For example, the second pulse may be sent to the reversible power cable over the CC signal connected to the power source at the CC1 port/pin. In at least some embodiments, the second pulse may cause the CC signal to drive the second LED whether or not the reversable cable is connected to a power sink at the opposite end.

At 508, the method may include, responsive to detecting that the connector at the opposite end of the reversable power cable is connected to a power sink, modifying the LED driver path for the second LED. For example, in at least some embodiments, the driver path for the second LED may be switched from the CC signal on the reversable power cable to the Vbus signal on the reversable power cable, as described herein.

Figure 6:
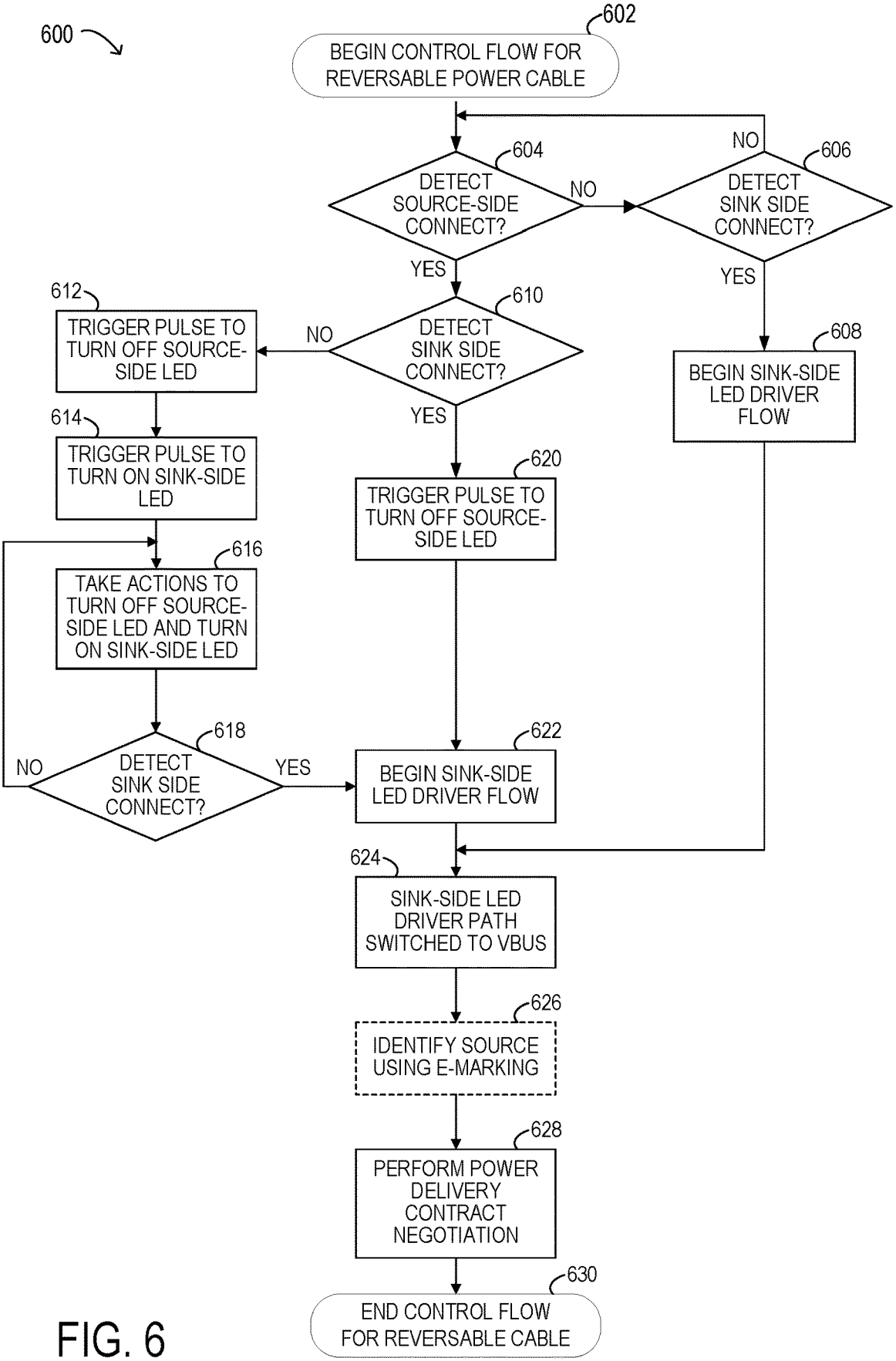
FIG. 6 is flow diagram illustrating selected elements of a control flow method for a detachable reversable power cable of an information handling system.

Referring now to FIG. 6, selected elements of an embodiment of a control flow method 600 for a detachable reversable power cable of an information handling system, as described herein, is depicted in flowchart form. In certain embodiments, one or more operations of method 600 may be performed by a power delivery controller of a power source, such as power delivery controller 174 of DC power source 172 illustrated in FIG. 1 or power delivery controller 174 of power source 310 illustrated in FIGS. 3A through 3D. Method 600 may be performed repeatedly or continuously to control the functionality and use of a reversable power cable when the reversable power cable is attached or re-attached to a power source or to a power sink. It is noted that certain operations described in method 600 may be optional or may be rearranged in different embodiments.

Control flow method 600 may begin, at 602. If, at 604, a connection of the reversable power cable to a power source (i.e., a "source-side" connection) is detected, the method may continue at 610. Otherwise, the method may proceed to 606.

If, at 606, a connection of the reversable power cable to a power sink (i.e., a "sink-side" connection) is detected, the method may continue at 608. Otherwise, the method may return to 604 after which the operations shown in 604 and 606 may be repeated one or more times until either a source-side connection to the reversable power cable or a sink-side connection to the reversable power cable is detected.

At 608, the method may include beginning a sink-side LED driver flow. In some embodiments, a pulse-width modulation (PWM) signal may be used to drive and control the brightness of the sink-side LED. For example, the period of the PWM signal may control the brightness of the sink-side LED and the PWM signal may be converted to a DC control voltage that drives the LED current.

If, at 610, a sink-side connection to the reversable power cable is detected, method 600 may continue to 620. Otherwise, the method may proceed to 612. At 620, method 600 may include triggering a pulse to turn off the LED in the source-side connector, as described herein. At 622, the method may include beginning a sink-side LED driver flow. Here again, a PWM signal may be used to drive and control the brightness of the sink-side LED, as described above.

At 612, the method may include triggering a first pulse to turn off the LED in the source-side connector, as described herein. At 614, the method may include triggering a pulse to turn on the LED in the sink-side connector, as described herein. At 616, method 600 may include, in response to the triggers, taking actions to turn off the source-side LED and to turn on the sink-side LED.

If, at 618, a sink-side connection to the reversable power cable is detected, method 600 may continue to 622. Otherwise, the method may return to and repeat the operations shown in 616 one or more times until and unless a sink-side connection to the reversable power cable is detected at 618.

After beginning the sink-side LED driver flow, at 622, the method may continue to 624, wherein the sink-side LED driver path is modified by being switched from the CC1 signal to the Vbus signal, as described herein.

At 626, in embodiments in which the connectors of the reversable power cable include respective electronic marking modules, method 600 may include identifying the power source and its capabilities using electronic marking, after which the method may include performing a power delivery contract negotiation between the power source and the power sink, as in 628. In the illustrated example, control flow method 600 ends at 630.

As disclosed herein, existing configuration channel signals and corresponding wires of a detachable reversable USB Type-C cable may be leveraged to control LEDs at each end of the cable without interfering with CC signal communication between a power source and a power sink. The disclosed techniques for LED control for a reversable power cable provide multiple advantages over existing solutions for controlling LEDs at both ends of a reversable detachable power cable including, but not limited to:

- Reducing power consumption by turning on only the sink-side LED and only doing so when the reversable detachable power cable is attached to a power source, making it possible to comply with applicable no-load, DoE, and EU CoC standards for external power supplies.
- Eliminating LED constant current discrete circuitry at the end of the cable in favor of circuitry embedded into electronic marking circuitry.
- Providing a sink-side LED of a power adapter that is always on when the power adapter is connected to AC line power, even when the power adapter is detached from an information handling system and the DC output voltage is zero.
- Controlling the LEDs at both ends of a reversable power cable to ensure that only a single one of the LEDs is on without impacting other operations in a no load condition.

The above disclosed subject matter is to be considered illustrative, and not restrictive, and the appended claims are intended to cover all such modifications, enhancements, and other embodiments which fall within the true spirit and scope of the present disclosure. Thus, to the maximum extent allowed by law, the scope of the present disclosure is to be determined by the broadest permissible interpretation of the following claims and their equivalents, and shall not be restricted or limited by the foregoing detailed description.

What is claimed is:

1. A method, comprising:

detecting, at a power source, that a first connector at a first end of a reversable power cable is connected to the power source;

triggering, at the power source, a first pulse on a first wire of the reversable power cable that turns off a first light emitting diode (LED) switch coupled to a first LED on the first connector at the first end of the reversable power cable, disabling the first LED; and triggering, at the power source, a second pulse on a second wire of the reversable power cable that drives a second LED on a second connector at a second end of the reversable power cable opposite the first end, the second LED being coupled to a second LED switch that is on.

2. The method of claim 1, further comprising, responsive to detecting that the second connector at the second end of the reversable power cable is connected to a power sink, modifying a signal path for the second LED on the second connector.

3. The method of claim 2, wherein:

the first wire on the reversable power cable carries a first configuration channel signal;

the second wire on the reversable power cable carries a second configuration channel signal; and modifying the signal path for the second LED on the second connector comprises:

decoupling the signal path of the second configuration channel signal for the second LED from the second wire on the reversable power cable; and coupling another signal path for the second LED to a third wire on the reversable power cable, the third wire carrying a power bus signal.

4. The method of claim 1, wherein:

the first wire on the reversable power cable carries a first configuration channel signal; and triggering the first pulse comprises initiating, by a power delivery controller at the power source, a pulse on the first configuration channel signal, the first configuration channel signal being coupled to the first LED switch.

5. The method of claim 1, further comprising, prior to detecting that the first connector at the first end of the reversable power cable is connected to the power source, detecting that the second connector at the second end of the reversable power cable is connected to a power sink.

6. The method of claim 1, further comprising, subsequent to triggering the second pulse, detecting that the second connector at the second end of the reversable power cable is connected to a power sink.

7. The method of claim 1, further comprising, responsive to a disconnection of the reversable power cable from the power source, disabling the first LED and the second LED.

8. The method of claim 1, further comprising, responsive to disconnection of the reversable power cable from the power sink, disabling the first LED and the second LED.

9. A system, comprising:

a reversable power cable, comprising:

a first connector at a first end of the reversable power cable including:

a first light emitting diode (LED); and a first LED switch coupled to the first LED and operable to:

disable the first LED when the first LED switch is off; and couple the first LED to a driving current source when the first LED switch is on;

a second connector at a second end of the reversable power cable including:

a second LED; and a second LED switch coupled to the second LED and operable to:

disable the second LED when the second LED switch is off; and couple the second LED to a driving current source when the second LED switch is on; and a length of cable between the first connector and the second connector including respective wires carrying:

a power bus signal;

a first configuration channel signal; and a second configuration channel signal; and an external power source for an information handling system, comprising:

a port for coupling the external power source to the reversable power cable; and a power delivery controller comprising circuitry operable to:

detect that the first connector is connected to the external power source;

trigger a first pulse on the first configuration channel signal to turn off the first LED switch, disabling the first LED; and trigger a second pulse on the second configuration channel signal to provide a drive current to the second LED while the second LED switch is on.

10. The system of claim 9, wherein the power delivery controller further comprises circuitry operable to, responsive to detecting that the second connector at the second end of the reversable power cable is connected to a power sink:

decoupling a signal path of the second configuration channel for the second LED from the second wire on the reversable power cable; and coupling another signal path for the second LED to a third wire on the reversable power cable, the third wire carrying a power bus signal.

11. The system of claim 9, wherein the power delivery controller further comprises circuitry operable to detect that the second connector at the second end of the reversable power cable is connected to a power sink prior to detecting that the first connector at the first end of the reversable power cable is connected to the power source.

12. The system of claim 9, wherein the power delivery controller further comprises circuitry operable to detect, subsequent to triggering the second pulse, that the second connector at the second end of the reversable power cable is connected to a power sink.

13. The system of claim 9, wherein the power delivery controller further comprises circuitry operable to disable the first LED and the second LED responsive to a disconnection of the reversable power cable from the power source.

14. The system of claim 9, wherein the power delivery controller further comprises circuitry operable to disable the first LED and the second LED responsive to a disconnection of the reversable power cable from the power sink.

15. An external power source for an information handling system, comprising:

a port for coupling the external power source to the reversable power cable; and a power delivery controller comprising circuitry operable to:

detect that a first connector at a first end of the reversable power cable is connected to the port on the external power source;

trigger a first pulse on a first wire of the reversable power cable that turns off a first light emitting diode (LED) switch coupled to a first LED on the first connector at the first end of the reversable power cable, disabling the first LED; and trigger a second pulse on a second wire of the reversable power cable that drives a second LED on a second connector at a second end of the reversable power cable opposite the first end, the second LED being coupled to a second LED switch that is on.

16. The external power source of claim 15, wherein the first wire on the reversable power cable carries a first configuration channel signal and the second wire on the reversable power cable carries a second configuration channel signal, and wherein the power delivery controller further comprises circuitry operable to, responsive to detecting that the second connector at the second end of the reversable power cable is connected to a power sink:

decouple signal path of the second configuration channel for the second LED from the second wire on the reversable power cable; and couple another signal path for the second LED to a third wire on the reversable power cable, the third wire carrying a power bus signal.

17. The external power source of claim 15, wherein the power delivery controller further comprises circuitry operable to detect that the second connector at the second end of the reversable power cable is connected to a power sink prior to detecting that the first connector at the first end of the reversable power cable is connected to the power source.

18. The external power source of claim 15, wherein the power delivery controller further comprises circuitry operable to detect, subsequent to triggering the second pulse, that the second connector at the second end of the reversable power cable is connected to a power sink.

19. The external power source of claim 15, wherein the power delivery controller further comprises circuitry operable to disable the first LED and the second LED responsive to a disconnection of the reversable power cable from the power source or a disconnection of the reversable power cable from the power sink.

20. The external power source of claim 15, further comprising at least one of:

a battery; and an AC-DC converter.

* * * * *